US010152000B2

(12) United States Patent
Ariizumi

(10) Patent No.: US 10,152,000 B2
(45) Date of Patent: Dec. 11, 2018

(54) DEVELOPING DEVICE

(71) Applicant: CANON KABUSHIKI KAISHA, Tokyo (JP)

(72) Inventor: Osamu Ariizumi, Matsudo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/645,357

(22) Filed: Jul. 10, 2017

(65) Prior Publication Data

US 2018/0017895 A1 Jan. 18, 2018

(30) Foreign Application Priority Data

Jul. 15, 2016 (JP) ..... 2016-140688
May 9, 2017 (JP) ..... 2017-093144

(51) Int. Cl.
*G03G 15/08* (2006.01)

(52) U.S. Cl.
CPC ..... *G03G 15/0891* (2013.01)

(58) Field of Classification Search
CPC ..... G03G 15/0893; G03G 15/0877; G03G 2215/0822; G03G 2215/0827
USPC ..... 399/256
See application file for complete search history.

(56) References Cited

U.S. PATENT DOCUMENTS 8,326,180 B2 12/2012 Fujiwara et al.
8,626,034 B2 1/2014 Koike et al.
8,787,802 B2 7/2014 Hattori et al.
2010/0215401 A1 8/2010 Fujiwara et al.
2012/0163874 A1 6/2012 Hattori et al.
2012/0219326 A1* 8/2012 Koike ..... G03G 15/0893 399/254
2017/0052482 A1* 2/2017 Ishida ..... G03G 15/0844

FOREIGN PATENT DOCUMENTS

JP S59100471 A 6/1984
JP 2009192554 A 8/2009
JP 2010197539 A 9/2010
JP 2012133119 A 7/2012
JP 2012133212 A 7/2012
JP 2012181286 A 9/2012

* cited by examiner

*Primary Examiner* — Walter L Lindsay, Jr.
*Assistant Examiner* — Frederick Wenderoth
(74) *Attorney, Agent, or Firm* — Fitzpatrick, Cella, Harper & Scinto

(57) ABSTRACT

A developing device includes a first communication portion defining a communication path through which developer in a second chamber is communicated to a first chamber. The communication path has a first area and a second area. The first area is positioned within a range corresponding to a developer coating area of a developer bearing member in a conveyance direction of developer in the collection chamber, while the second area is positioned downstream of the developer coating area in the conveyance direction. A first length of the first area is shorter than a second length of the second area. The first length is a maximum length from a bottom surface portion of the communication path to an upper portion of the first area, and the second length is a maximum length from the bottom surface portion of the communication path to an upper portion of the second area.

15 Claims, 7 Drawing Sheets

DEVELOPING DEVICE

BACKGROUND OF THE INVENTION

Field of the Invention

The present invention relates to a developing device.

Description of the Related Art

Japanese Patent Laid-Open No. 2012-181286 discloses a developing device of a so-called separate-function type in which a function of supplying developer to a developer bearing member and a function of collecting developer having passed through a development area opposing an image bearing member from the developer bearing member are separated from each other.

In the developing device of a separate-function type, a developer surface in a supply chamber from which the developer is supplied to the developer bearing member tends to have a shape in which a more upstream portion thereof is higher than a more downstream portion thereof in a developer conveyance direction in the supply chamber. In addition, a developer surface in a collection chamber in which the developer having passed through the development area is collected from the developer bearing member tends to have a shape in which a more upstream portion thereof is higher than a more downstream portion thereof in a developer conveyance direction in the collection chamber.

In recent years, miniaturization of devices has been desired, and, for a developing device, it is desired that the length of the developing device in a longitudinal direction is reduced. With regard to this point, in the developing device disclosed in Japanese Patent Laid-Open No. 2012-181286, a cutout portion is provided in an upper portion of an area of a partition wall separating the supply chamber from the collection chamber. The area opposes a developer coating area of a developer bearing member. Further, the developing device has a configuration in which developer in the collection chamber is permitted to be communicated from the collection chamber to the supply chamber through the cutout portion.

However, in the case where such a configuration of a developing device of a separate-function type is employed, a downstream portion in the developer conveyance direction of the developer surface in the collection chamber becomes so high as to reach the cutout portion. Therefore, there is a possibility that developer having just been collected in a downstream portion of the collection chamber in the developer conveyance direction, that is, developer whose toner density is lowered, is communicated from the collection chamber to the supply chamber through the cutout portion without being agitated.

Therefore, a new configuration of a developing device of a separate-function type in which developer whose toner density is lowered being communicated from a collection chamber to a supply chamber without being agitated is suppressed even in the case where a part of a communication portion that permits the developer in the collection chamber to be communicated to the supply chamber is disposed so as to oppose a developer coating area of a developer bearing member is desired.

SUMMARY OF THE INVENTION

The present invention provides a device having a configuration in which developer whose toner density is lowered being communicated from a collection chamber to a supply chamber without being agitated is suppressed even in the case where a part of a communication portion that permits the developer in the collection chamber to be communicated to the supply chamber is caused to oppose a developer coating area of a developer bearing member.

According to one aspect of the present invention, a developing device includes a developer bearing member configured to be rotatable, bear developer containing toner and carrier, and convey the developer to a development area opposing an image bearing member, a first chamber which is disposed below a rotation axis of the developer bearing member in a vertical direction and from which the developer is supplied to the developer bearing member, a second chamber disposed so as to be exposed to the developer bearing member and configured to accommodate the developer having passed through the development area and collected from the developer bearing member, a first conveyance screw portion disposed in the first chamber and configured to convey the developer in the first chamber in a first conveyance direction, a second conveyance screw portion disposed in the second chamber, including a rotatable shaft portion, and configured to convey the developer in the second chamber in a second conveyance direction opposite to the first conveyance direction, a partition wall configured to separate the first chamber from the second chamber, a first communication portion configured to permit the developer in the second chamber to be communicated from the second chamber to the first chamber, and a second communication portion configured to permit the developer in the first chamber to be communicated from the first chamber to the second chamber. The first communication portion defines a communication path through which the developer in the second chamber is communicated from the second chamber to the first chamber, the communication path having a first area and a second area, the first area being positioned within a range corresponding to a developer coating area of the developer bearing member in the second conveyance direction, the second area being positioned downstream of the developer coating area of the developer bearing member in the second conveyance direction. A first length of the first area is shorter than a second length of the second area, the first length being a maximum length from a bottom surface portion of the communication path to an upper portion of the first area of the communication path, the second length being a maximum length from the bottom surface portion of the communication path to an upper portion of the second area of the communication path.

Further features of the present invention will become apparent from the following description of exemplary embodiments with reference to the attached drawings.

DESCRIPTION OF THE EMBODIMENTS

Figure 1:
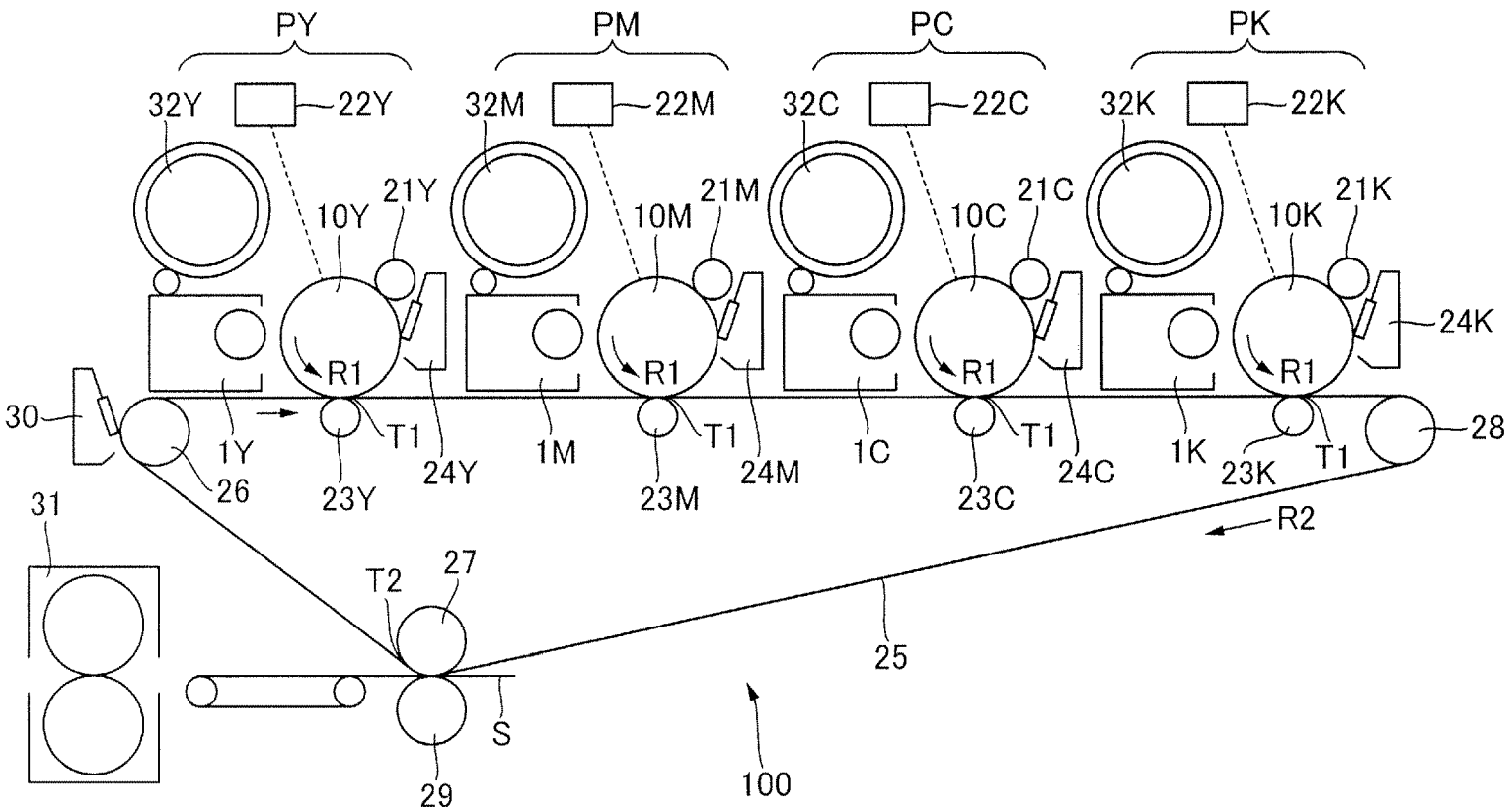
FIG. 1 is a schematic diagram illustrating a configuration of an image forming apparatus including a developing device according to an exemplary embodiment.

First, a configuration of an image forming apparatus 100 including a developing device according to an exemplary embodiment will be described with reference to FIG. 1. An image forming apparatus illustrated in FIG. 1 is a full-color printer of a tandem type employing an intermediate transfer system and including image forming portions PY, PM, PC, and PK arranged along an intermediate transfer belt 25.

Image Forming Apparatus

In the image forming portion PY, a yellow toner image is formed on a photosensitive drum 10Y, and is transferred onto the intermediate transfer belt 25. In the image forming portion PM, a magenta toner image is formed on a photosensitive drum 10M, and is transferred onto the intermediate transfer belt 25. In the image forming portions PC and PK, cyan and black toner images are respectively formed on photosensitive drums 10C and 10K, and are transferred onto the intermediate transfer belt 25. The toner images of four colors transferred onto the intermediate transfer belt 25 are conveyed to a secondary transfer portion T2 serving as a secondary transfer nip portion, and are collectively transferred onto a recording material S through secondary transfer. Examples of the recording material S include sheet materials such as paper sheets and overhead projector sheets. The recording material S is taken out one by one from a sheet feed cassette that is not illustrated, and is conveyed to the secondary transfer portion T2.

The image forming portions PY, PM, PC, and PK are configured in substantially the same manner except that colors of toner used in developing devices 1Y, 1M, 1C, and 1K, that is, yellow, magenta, cyan, and black, respectively, are different. Configurations and operations of the image forming portions PY to PK will be described below while omitting Y, M, C, and K at the end of the reference signs of the image forming portions PY to PK distinguishing the image forming portions PY to PK from each other.

In an image forming portion P, a charging roller 21, an exposing unit 22, a developing device 1, a transfer roller 23, and a drum cleaning unit 24 are disposed around a photosensitive drum 10 serving as an image bearing member. The photosensitive drum 10 is constituted by an aluminum cylinder and a photosensitive layer formed on an outer peripheral surface of the aluminum cylinder, and is rotated in an arrow R1 direction in FIG. 1 at a predetermined process speed.

The charging roller 21 uniformly charges the photosensitive drum 10 to a dark potential of a negative polarity by being subjected to a charging voltage applied thereto and coming into contact with the photosensitive drum 10. The exposing unit 22 generates, by a laser emitting element, a laser beam that is on-off keyed on the basis of scanning line image data in which decomposed images of respective colors are loaded, scans the charged surface of the photosensitive drum 10 with the laser beam via a rotating mirror, and thereby draws an electrostatic image on the surface of the photosensitive drum 10. The developing device 1 supplies toner to the photosensitive drum 10 to develop the electrostatic image as a toner image. The developing device 1 will be described in detail later with reference to FIGS. 2 to 6.

The transfer roller 23 is disposed so as to oppose the photosensitive drum 10 with the intermediate transfer belt 25 interposed therebetween, and thereby forms a primary transfer portion T1 of a toner image serving as a primary transfer nip portion between the photosensitive drum 10 and the intermediate transfer belt 25. At the primary transfer portion T1, the toner image is transferred from the photosensitive drum 10 onto the intermediate transfer belt 25 through primary transfer as a result of, for example, the transfer roller 23 being subjected to a primary transfer voltage applied thereto from a high-voltage power source that is not illustrated. That is, in the case where a primary transfer voltage of a polarity opposite to a charging polarity of the toner is applied to the transfer roller 23, the toner image on the photosensitive drum 10 is electrostatically attracted to the intermediate transfer belt 25, and thereby the toner image is transferred. The drum cleaning unit 24 rubs the photosensitive drum 10 with a cleaning blade to remove primary transfer residual toner remaining on the photosensitive drum 10 by a small amount after the primary transfer.

The intermediate transfer belt 25 is supported by being stretched over rollers including a tension roller 26, a secondary transfer inner roller 27, and a driving roller 28, and is driven by the driving roller 28 to rotate in an arrow R2 direction in FIG. 1. The secondary transfer portion T2 is a toner image transfer nip portion for transfer onto the recording material S, and is formed by a portion of the intermediate transfer belt 25 supported by the secondary transfer inner roller 27 and a secondary transfer outer roller 29 abutting the portion of the intermediate transfer belt 25. At the secondary transfer portion T2, the toner image is transferred through secondary transfer from the intermediate transfer belt 25 onto the recording material S nipped and conveyed in the secondary transfer portion T2 as a result of a predetermined secondary transfer voltage being applied to the secondary transfer inner roller 27. Secondary transfer residual toner remaining attached to the intermediate transfer belt 25 after the secondary transfer is removed by a belt cleaning unit 30 rubbing the intermediate transfer belt 25. The belt cleaning unit 30 rubs the intermediate transfer belt 25 with a cleaning blade to remove the secondary transfer residual toner.

The recording material S onto which the toner image of four colors has been transferred through the secondary transfer at the secondary transfer portion T2 is conveyed to a fixing unit 31. The fixing unit 31 applies pressure and heat to the recording material S to melt and fix the toner image on the recording material S. The pressure is applied by opposing rollers or belts that are not illustrated, and the heat is generally applied by a heat source such as a heater that is not illustrated. The recording material S onto which the toner image has been fixed by the fixing unit 31 is discharged to the outside of the apparatus.

A toner supplying unit 32 is capable of supplying, to the developing device 1, toner of an amount corresponding to the amount of consumed toner in accordance with toner in the developing device 1 consumed in image formation. More specifically, the toner supplying unit 32 is capable of supplying a replenishment.

Developing Device

Figure 2:
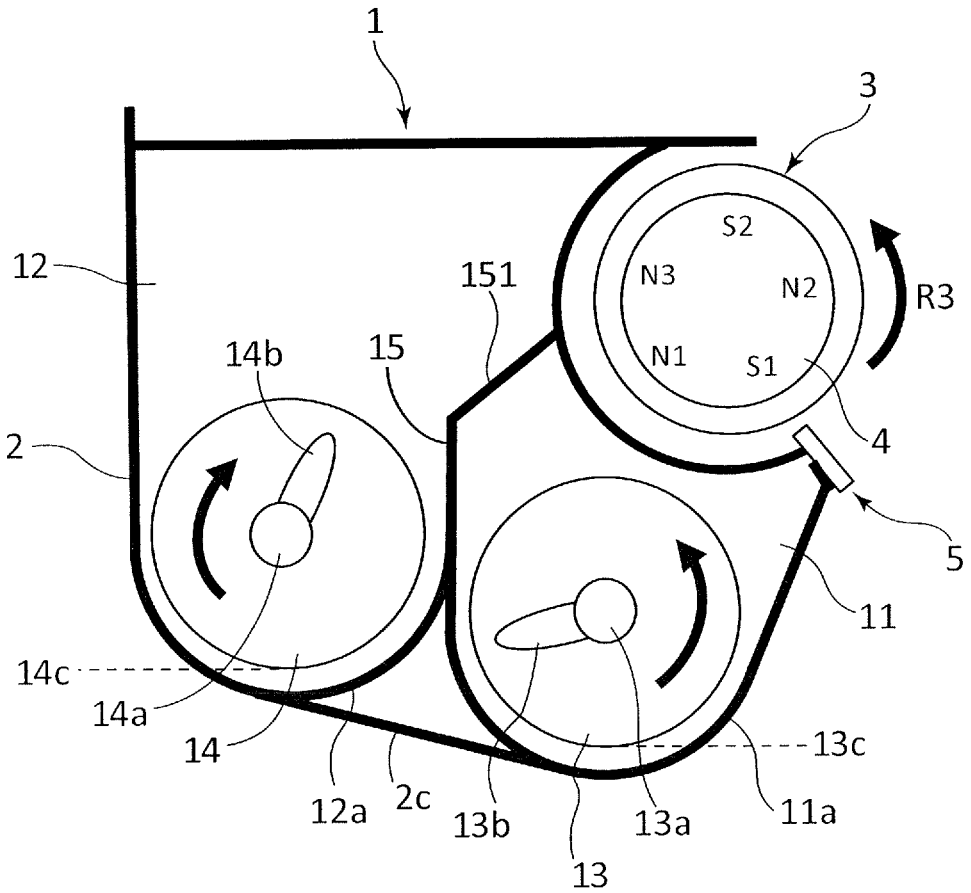
FIG. 2 is a section view of the developing device according to the exemplary embodiment.

The developing device 1 of the present exemplary embodiment will be described with reference to FIGS. 2 to 4. As illustrated in FIG. 2, the developing device 1 includes a development container 2 serving as a housing, a developing sleeve 3 serving as a developer bearing member, a regulation blade 5, a development screw 13 serving as a first conveyance screw, an agitation screw 14 serving as a second conveyance screw, and so forth.

The development container 2 accommodates two-component developer containing nonmagnetic toner and magnetic carrier. That is, a two-component development method is used as a development method in the present exemplary embodiment, a mixture of negatively chargeable nonmagnetic toner and positively chargeable magnetic carrier is used as the developer. The nonmagnetic toner is powder formed of resin, such as polyester and styrene acrylic resin, containing colorant, a wax component, and so forth, and obtained through crushing or polymerization. The magnetic carrier is constituted by a core and a surface layer of resin coating on the core. The core is a ferrite particle or a resin particle kneaded with magnetic powder. For example, the toner density of the developer in an initial state is 8% in the present exemplary embodiment. The toner density is a proportion or ratio of the weight of toner with respect to the total weight of the developer, and is also referred to as a TD ratio.

The development container 2 includes an opening portion in a portion opposing the photosensitive drum 10 illustrated in FIG. 1, and the developing sleeve 3 serving as a developer bearing member is rotatably disposed such that the developing sleeve 3 is partially exposed through the opening portion. The developing sleeve 3 is formed of a nonmagnetic material such as aluminum alloy and in a cylindrical shape, and is rotated in an arrow R3 direction in FIG. 2. The developing sleeve 3 includes a developer coating area capable of bearing developer on the surface thereof. The developer coating area serves as a bearing area. The developer coating area of the developing sleeve is an area corresponding to the largest area of an electrostatic latent image that can be formed on the surface of the photosensitive drum 10. The largest area is also referred to as the largest image area. In addition, a magnet roller 4 constituted by plural magnetic poles is unrotatably disposed in a space surrounded by the developing sleeve 3.

The developing sleeve 3 rotates in the arrow R3 direction in FIG. 2, and bears and conveys developer attracted at a position of a pulling-up pole N1 toward the regulation blade 5. Developer napped by a regulation pole S1 is subjected to a shearing force from the regulation blade 5 when passing through a gap between the developing sleeve 3 and the regulation blade 5, and the amount thereof is thereby regulated. Thus, a developer layer of a predetermined thickness is formed on the developing sleeve 3. The developer layer that has been formed is conveyed to a development area where the developing sleeve 3 opposes the photosensitive drum 10, and develops an electrostatic latent image formed on the surface of the photosensitive drum 10 in a state in which a magnetic nap is formed by a development pole N2. Developer having gone through the development is peeled off the developing sleeve 3 by a nonmagnetic field formed by two poles of the same polarity adjacent to each other, that is, the pulling-up pole N1 and a peeling pole N3.

Development Container

The development container 2 includes a development chamber 11 serving as a first chamber and an agitation chamber 12 serving as a second chamber, and a partition wall 15 separating the development chamber 11 and the agitation chamber 12 from each other is provided between the development chamber 11 and the agitation chamber 12. The partition wall 15 projects in the development container 2 from a bottom surface portion 2*c* such that the development chamber 11 and the agitation chamber 12 are separated from each other. In addition, the partition wall 15 extends in a rotation axis direction of the developing sleeve 3, and the development chamber 11 and the agitation chamber 12 are formed along the rotation axis direction of the developing sleeve 3. In the present exemplary embodiment, the development chamber 11 and the agitation chamber 12 are disposed at different heights when viewed in the horizontal direction such that a bottom surface portion 12*a* of the agitation chamber 12 is positioned above a bottom surface portion 11*a* of the development chamber 11. In the description below, "above" and "below" respectively indicate above and below in the gravity direction, or the vertical direction.

Figure 3:
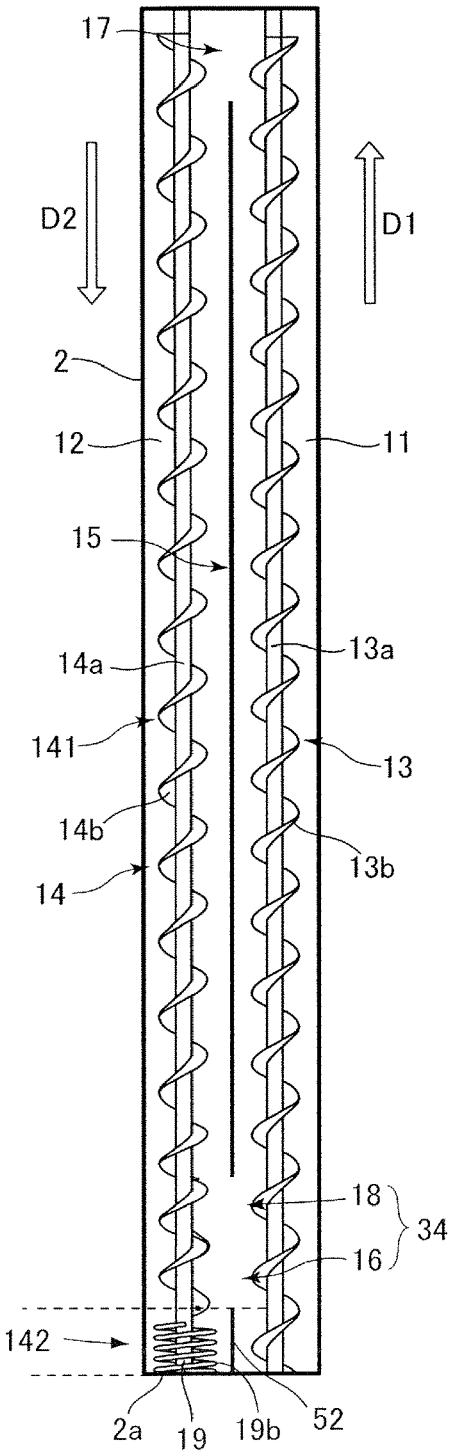
FIG. 3 is a top view of a section of the developing device taken along a horizontal plane including an axial direction.

As illustrated in FIG. 3, the partition wall 15 includes, at respective ends in a longitudinal direction, a first communication port 16 and a second communication port 17 through each of which the development chamber 11 and the agitation chamber 12 communicate with each other. The first communication port 16 corresponds to a first communication portion that permits communication of developer, or transfer of developer, from the agitation chamber 12 to the development chamber 11, and the second communication port 17 corresponds to a second communication portion that permits communication of developer, or transfer of developer, from the development chamber 11 to the agitation chamber 12. The partition wall 15 also includes a third communication port 18 in addition to the first communication port 16 and the second communication port 17. The third communication port 18 is a communication portion of developer that permits communication of developer from the agitation chamber 12 to the development chamber 11 similarly to the first communication port 16. That is, the third communication port 18 constitutes the first communication portion with the first communication port 16. The third communication port 18 will be described later with reference to FIG. 4.

Further, as illustrated in FIG. 2, a guide member 151 that guides the developer peeled off the developing sleeve 3 to the agitation chamber 12 is provided in an upper portion of the partition wall 15. The guide member 151 is provided so as to extend in the vicinity of the developing sleeve 3. The guide member 151 is provided over a region including the coating area of the developing sleeve 3 on which the developing sleeve 3 is capable of bearing the developer.

As illustrated in FIG. 3, the development screw is provided in the development chamber 11. The development screw 13 serves as a first conveyance screw portion that conveys developer in a predetermined first direction D serving as a first conveyance direction in the development chamber 11. In the agitation chamber 12, the agitation screw 14 including a first conveyance portion 141 is provided. The first conveyance portion 141 conveys developer in a second direction D2 opposite to the first direction D1 in the agitation chamber 12. The agitation screw 14 corresponds to a second conveyance screw portion that conveys developer in a second conveyance direction. The development screw 13 and the agitation screw 14 are respectively constituted by rotation shafts 13*a* and 14*a* and ridges 13*b* and 14*b* serving as ridge portions formed in spiral shapes around the rotation shafts 13*a* and 14*a*. Each end portion of each of the rotation shafts 13*a* and 14*a* is rotatably supported by the development container 2. The development screw 13 and the agitation screw 14 are disposed so as to at least partially overlap with each other when viewed in the horizontal direction. In the present exemplary embodiment, the development screw 13 and the agitation screw 14 are disposed such that a lower end 14*c* of the agitation screw 14 is above a lower end 13*c* of the development screw 13 when viewed in the horizontal direction as illustrated in FIG. 2. The development screw and the agitation screw 14 are formed such that the diameter of the rotation shafts 13*a* and 14*a* is 6 mm, the diameter of the ridges 13*b* and 14*b* is 18 mm, and the screw pitch of the development screw 13 and the agitation screw 14 is 40 mm.

The developing sleeve 3, the development screw 13, and the agitation screw 14 are each configured to be connected to and driven by a gear train that is not illustrated, and are each rotated by a driving force transmitted from a driving motor that is not illustrated via the gear train. The developer is conveyed in a circulating manner by the rotation of the development screw 13 and the agitation screw 14 as indicated by arrows in FIG. 3. At this time, the developer is communicated from the agitation chamber 12 to the development chamber 11 through the first communication port 16, and from the development chamber 11 to the agitation chamber 12 through the second communication port 17, respectively. A circulation path of developer in the development chamber 11 and the agitation chamber 12 is formed in this way, and thus the developer is mixed and agitated by being circulated through the circulation path.

The developer is supplied from the development chamber 11 to the developing sleeve 3, and the developer peeled off the developing sleeve 3 is collected in the agitation chamber 12. That is, the developer in the development chamber 11 is attracted to the developing sleeve 3 at a position corresponding to the pulling-up pole N1 of the magnet roller 4 while being conveyed by the development screw 13. The guide member 151 provided in the upper portion of the partition wall 15 is provided so as to extend from the upper end of the partition wall 15 to the vicinity of the portion of the developing sleeve 3 corresponding to the nonmagnetic field. Therefore, the developer peeled off the developing sleeve 3 by the peeling pole N3 is collected in the agitation chamber 12 without returning to the development chamber 11. In the agitation chamber 12, the collected developer is conveyed by the agitation screw 14 while collecting the developer.

In the developing device 1 that performs development by using two-component developer, a charge imparting ability, in other words, a charging performance, of the carrier to the toner may be lowered in the course of image formation. In this case, the charge of toner is reduced, and image defects such as density variation and scattered fogging may occur. Thus, control of supplying a replenishment from the toner supplying unit 32 illustrated in FIG. 1 connected to an unillustrated supply port of the developing device 1 to refresh the carrier is performed in order to restore the charging performance of the carrier. The control is performed in a so-called auto carrier refresh method: ACR method. In a developing device employing the ACR method, excessively supplied developer is discharged to the outside of a development container through a discharge port. That is, the developing device 1 includes a supply port serving as a developer supplying portion for supplying developer and a discharge port serving as a developer discharging portion for discharging developer.

Discharge Port

Figure 4:
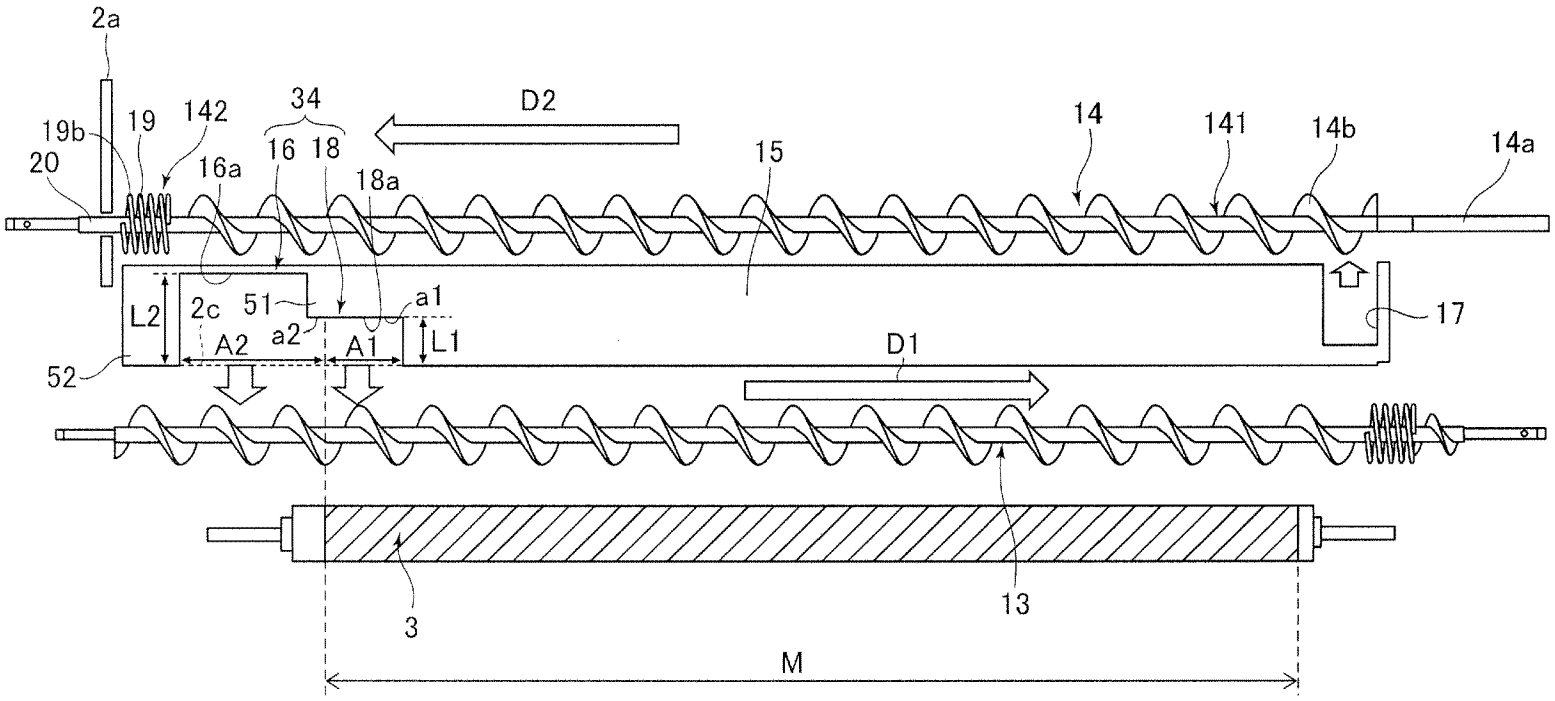
FIG. 4 is a schematic diagram for description of a third communication port.

As illustrated in FIG. 3, the development container 2 includes a wall portion 2*a* disposed in a direction intersecting the second direction D2 at a downstream end of the agitation chamber 12 in the second direction D2, and, as illustrated in FIG. 4, a discharge port 20 is defined in the wall portion 2*a*. The discharge port 20 is defined as a through hole through which a shaft portion of the rotation shaft 14*a* of the agitation screw 14 on which a ridge is not formed penetrates such that a gap is provided between the discharge port 20 and the outer periphery of the shaft portion of the rotation shaft 14*a*. For example, the shaft diameter of the rotation shaft 14*a* of the agitation screw 14 is set to 6 mm, and the diameter of the discharge port 20 is set to 8 mm.

It may be also considered to define the discharge port 20 not in the wall portion 2*a* at an end of the development container 2 but at a predetermined height in a conveyance path in the agitation chamber 12, that is, in a side wall surface opposing the first conveyance portion 141. However, in such a case, there may be a case that the developer is discharged through the discharge port 20 by being struck up by the agitation screw 14 in addition to a case where the developer is discharged through the discharge port 20 as a result of an overflow. That is, compared with the present exemplary embodiment in which the discharge port 20 is defined in the wall portion 2*a* at the end of the development container 2, the developer is likely to be discharged regardless of the amount of developer accommodated in the agitation chamber 12, and the developer may be sometimes reduced too much. In this case, particularly in the development chamber 11, a sufficient amount of developer is not ensured on the upstream side of the development screw 13 in the first direction D1, and the coating area of the developing sleeve 3 becomes less likely to be uniformly coated. In the case where this coating failure occurs, image defects such as reduction of image density and occurrence of white streaks on an image may be caused. To avoid this, it is preferable that the discharge port 20 is defined in the wall portion 2*a* at the end of the development container 2 at which the influence of striking up is small as in the present exemplary embodiment.

Returning Screw

As illustrated in FIG. 4, the agitation screw 14 includes a returning portion 142 downstream of the first conveyance portion 141 in which the ridge 14*b* is formed around the rotation shaft 14*a*. The returning portion 142 is provided downstream of the first conveyance portion 141 in the second direction D2, more specifically, between the discharge port 20 and a downstream end portion of the ridge 14*b*. The returning portion 142 is a returning screw 19 in which a returning ridge 19*b* swirling in the opposite direction to the ridge 14*b* is formed around the rotation shaft 14*a* and which conveys the developer in the first direction D1, that is, in the direction opposite to the conveyance direction of the ridge 14*b*. The returning screw 19 is formed such that the screw pitch thereof is 3 mm and the length thereof in the rotation axis direction, that is, the longitudinal direction, of the agitation screw 14 is 15 mm.

In the case where a large amount of developer has reached to the most downstream portion of the first conveyance portion 141 of the agitation screw 14 and the developer surface of the developer has reached the height of the gap between the rotation shaft 14*a* and the discharge port 20, the developer is discharged through the gap. That is, most of the developer conveyed toward the discharge port 20 by the first conveyance portion 141 is pushed back upstream in the second direction D2 by the returning screw 19, and is communicated to the development chamber 11 through the first communication port 16 and the third communication port 18 without passing through the discharge port 20. The developer that has not been pushed back by the returning screw 19 moves downstream of the agitation chamber 12 through the discharge port 20 in accordance with the developer surface becoming higher than a lower end of the discharge port 20, and is thus discharged from the development container 2.

The developing device 1 of the present exemplary embodiment has a configuration of a so-called separate-function type in which developer is supplied from the development chamber 11 to the developing sleeve 3 and developer is collected from the developing sleeve 3 into the agitation chamber 12. In the developing device 1 of the separate-function type, the developer on the developing sleeve 3 is collected in the whole area of the agitation chamber 12 in the longitudinal direction. Therefore, the developer is circulated through two paths of a first path, through which the developer is conveyed from the development chamber 11 to the agitation chamber 12 not via the developing sleeve 3, and a second path, through which the developer is directly conveyed from the developing sleeve 3 to the agitation chamber 12, and the distribution of the amount of developer is likely to be non-uniform in the development container 2. The developer is likely to be accumulated on the downstream side in the agitation chamber 12, and thus a more downstream portion of the developer surface is likely to be higher than a more upstream portion thereof.

As has been already described, in a conventional developing device, the communication of developer from the agitation chamber 12 to the development chamber 11 is suppressed in the case where the fluidity of the developer is lowered. In this case, developer of a low toner density is dragged around the developing sleeve 3, and thus image defects such as density irregularity become more likely to occur. In addition, image defects may occur in the case where a sufficient amount of developer is not ensured on the upstream side of the development screw 13 in the development chamber 11 in the first direction D1, or on the downstream side of the agitation screw 14 in the second direction D2.

Third Communication Port

Therefore, in the present exemplary embodiment, the third communication port 18 is provided in the partition wall 15 in addition to the first communication port 16 and the second communication port 17 through which the developer is communicated between the development chamber 11 and the agitation chamber 12. The third communication port 18 will be described with reference to FIGS. 4 and 5.

As illustrated in FIG. 4, the third communication port 18 is defined at a position adjacent to and upstream of the first communication port 16 and upstream of a downstream end portion of the coating area M of the developing sleeve 3 in the second direction D2. That is, an upper end 18*a* defining an upper edge of the third communication port 18 provided in the partition wall 15 includes a portion a1 whose position in the second direction D2 is within a range corresponding to the coating area M and a portion a2 positioned downstream of the coating area M. The third communication port 18 constitutes, with the first communication port 16, a communication portion 34 serving as a first communication portion through which the developer is communicated from the agitation chamber 12 to the development chamber 11 as illustrated in FIG. 3. In addition, a communication path through which the developer in the agitation chamber 12 is communicated from the agitation chamber 12 to the development chamber 11 is formed in the communication portion 34. The third communication port 18 substantially widens the first communication port 16 compared with a conventional embodiment, and thus communication of the developer from the agitation chamber 12 to the development chamber 11 is promoted compared with the conventional embodiment.

Figure 5:
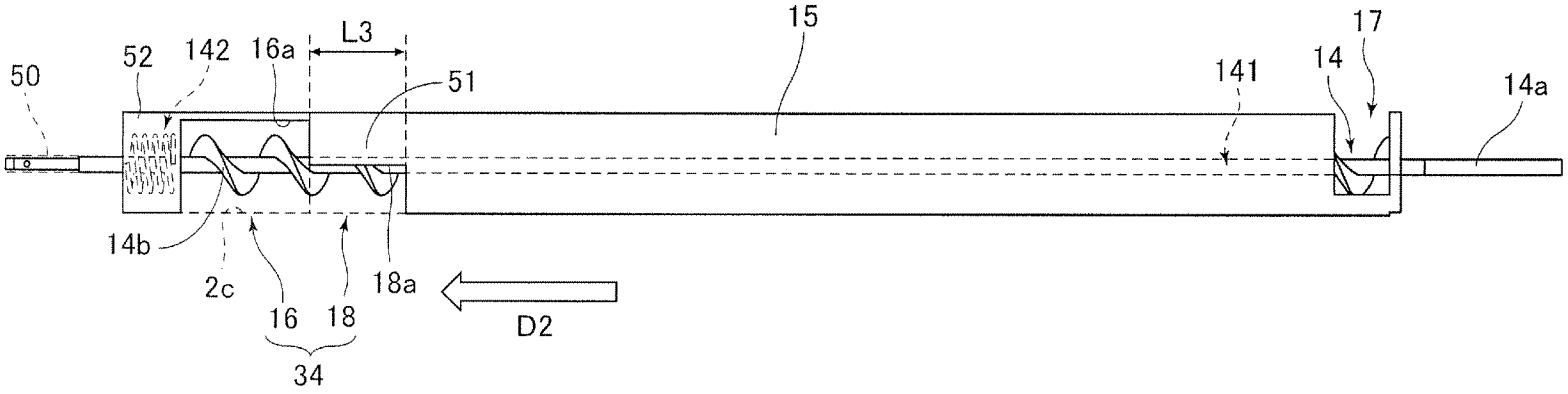
FIG. 5 is a schematic diagram illustrating a case where an agitation screw side is viewed from a development screw side.

However, in the case where the third communication port 18 merely widens the first communication port 16 to the downstream side, the developer peeled off the developing sleeve 3 and collected in the agitation chamber 12 may be communicated to the development chamber 11 without being agitated as has been described above. To avoid this, in the present exemplary embodiment, the upper end 18*a* of the third communication port 18 is disposed below an upper end 16*a* of the first communication port 16 as illustrated in FIG. 5. Specifically, the upper end 18*a* of the third communication port 18 is formed below a rotation axis 50 of the agitation screw 14, and the upper end 16*a* of the first communication port 16 is formed above the rotation axis 50 of the agitation screw 14. Therefore, when the agitation chamber 12 is viewed in a plane perpendicular to the partition wall 15, a height L1 of the upper end 18*a* of the third communication port 18 from a bottom surface portion of the communication path through which the developer in the agitation chamber 12 is communicated from the agitation chamber 12 to the development chamber 11, that is, the bottom surface portion 2*c*, is smaller than a height L2 of the upper end 16*a* of the first communication port 16 from the bottom surface portion 2*c* as illustrated in FIG. 4. That is, this is an exemplary configuration in which, in the case where the portion whose position in the second direction D2 is within the range corresponding to inside the coating area M is set as a first area A1 and the portion positioned downstream of the coating area M is set as a second area A2 in the opening of the communication portion 34, a second length that is the maximum height of the second area A2 is larger than a first length that is the maximum height of the first area A1.

When viewed in the plane perpendicular to the partition wall 15, the upper end 18*a* of the third communication port 18 corresponds to a portion at which the third communication port 18 intersects with the partition wall 15. In addition, when viewed in the plane perpendicular to the partition wall 15, the upper end 16*a* of the first communication port 16 corresponds to a portion at which the first communication port 16 intersects with a certain component constituting the developing device 1. Further, when viewed in the plane perpendicular to the partition wall 15, the certain component which constitutes the developing device 1 and with which the first communication port 16 intersects changes depending on the shape of the partition wall 15 extending in the rotation axis direction of the developing sleeve 3. In the present exemplary embodiment, the partition wall 15 is provided such that a part of the partition wall 15 extends above the first communication port 16 as illustrated in FIG. 5. Therefore, in the present exemplary embodiment, the first communication port 16 intersects with the part of the partition wall 15 at the upper end 16*a* when viewed in the plane perpendicular to the partition wall 15.

In a modification embodiment in which the part of the partition wall 15 does not extend above the first communication port 16, the upper end 16*a* of the first communication port 16 may have a following configuration when viewed in the plane perpendicular to the partition wall 15. For example, the upper end 16*a* of the first communication port 16 may be a portion at which the first communication port 16 intersects with the developing sleeve 3. In this case, an area other than the coating area M in the outer circumferential surface of the developing sleeve 3, in other words, a so-called non-coating area, is the certain component defining the upper end 16*a* of the first communication port 16, that is, the upper edge of the first area A1. In addition, for example, the upper end 16*a* is a portion at which the first communication port 16 intersects with "a cover frame body for covering a part of an opening portion of a frame body of the development container 2", in other words, "a so-called upper lid of the development container 2". In this case, an area other than the coating area M in the upper lid of the development container 2, in other words, a so-called non-coating area, is the certain component defining the upper end 16*a* of the first communication port 16, that is, the upper edge of the first area A1.

In addition, the third communication port 18 and the first communication port 16 are defined such that a downstream end portion of the third communication port 18, that is, the border between the third communication port 18 and the first communication port 16, is disposed downstream of the coating area M. That is, the first communication port 16 is disposed downstream of the coating area M. In the present exemplary embodiment, the height, that is, the length in a direction perpendicular to the second direction D2, of the third communication port 18 is constant. In addition, the second communication port 17 is disposed upstream of the coating area M.

As described above, whereas the first communication port 16 is defined so as not to overlap the coating area M, the third communication port 18 is defined so as to overlap the coating area M. Since the upper end 18*a* of the third communication port 18 is formed below the upper end 16*a* of the first communication port 16, the area of opening, i.e., a size of opening, of the third communication port 18 is restricted on the upper side by the partition wall 15 compared with the first communication port 16. Therefore, developer being conveyed on the lower side in the agitation chamber 12 is communicated to the development chamber 11 through the third communication port 18.

However, in the case where the width, that is, the length in the second direction D2, of the third communication port 18 is too large, the developer peeled off the developing sleeve 3 and collected in the agitation chamber 12 may be communicated to the development chamber 11 without being agitated. To avoid this, the width of the third communication port 18 is restricted. In the present exemplary embodiment, the third communication port 18 is defined such that a width L3 of the third communication port 18, more specifically a length of a portion of the third communication port 18 overlapping the coating area M, is shorter than the pitch of the ridge 14*b* of the agitation screw 14 as illustrated in FIG. 5. For example, the widths of the first communication port 16 and the second communication port 17 are set to 40 mm, and the width of the third communication port 18 is set to 20 mm, which is a half of 40 mm that is the screw pitch.

As described above, in the developing device 1 of the present exemplary embodiment, the first communication port 16 through which the developer can be communicated from the agitation chamber 12 to the development chamber 11 is substantially expanded by the third communication port 18. According to this, the communication of developer from the agitation chamber 12 to the development chamber 11 is not suppressed even in the case where the fluidity of the developer is lowered, and thus the developer is less likely to be dragged around by the developing sleeve 3. In addition, a sufficient amount of developer can be ensured on the upstream side of the development screw 13 in the first direction D1 in the development chamber 11, and thus the occurrence of image defects caused by coating failure can be reduced. In addition, the upper end 18*a* of the third communication port 18 is formed below the upper end 16*a* of the first communication port 16, and the third communication port 18 is configured such that the developer in a lower portion of the agitation chamber 12 can be communicated to the development chamber 11 through the third communication port 18. According to this, although the communication portion 34 is expanded to an area overlapping the coating area M of the developing sleeve 3, communication of the developer on the upper side in the agitation chamber 12 is prevented by a partition wall portion 51. Therefore, the developer guided to the agitation chamber 12 by the guide member 151 is not immediately communicated to the development chamber 11 but communicated to the development chamber 11 after being mixed with existing developer being conveyed in the agitation chamber 12. That is, since the developer of a low toner density peeled off the developing sleeve 3 and collected in the agitation chamber 12 is not communicated to the development chamber 11 without being sufficiently agitated, image defects caused by the communication of the developer of a low toner density can be suppressed.

Other Embodiments

As has been described, in the case of the developing device 1 of a separate-function type, the height of the developer surface in the agitation chamber 12 gradually increases from upstream to downstream of the agitation screw 14 in the second direction D2. In contrast, in the case where the height of the third communication port 18 is constant as in the exemplary embodiment described above and illustrated in FIG. 5, the developer surface may become lower than the upper end 18*a* of the third communication port 18 in the case where, for example, the amount of developer in the development container 2 is small. In this case, particularly on the upstream side of the third communication port 18 in the second direction D2, the developer peeled off the developing sleeve 3 and collected in the agitation chamber 12 can pass through the third communication port 18 without being blocked by the partition wall 15, that is, can be communicated to the development chamber 11 without being agitated.

Figure 6:
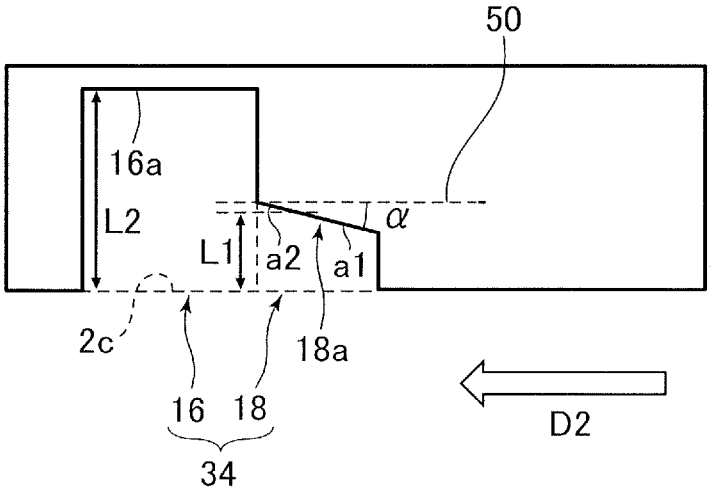
FIG. 6 is an enlarged view of a part of a partition wall according to another exemplary embodiment.
Figure 7:
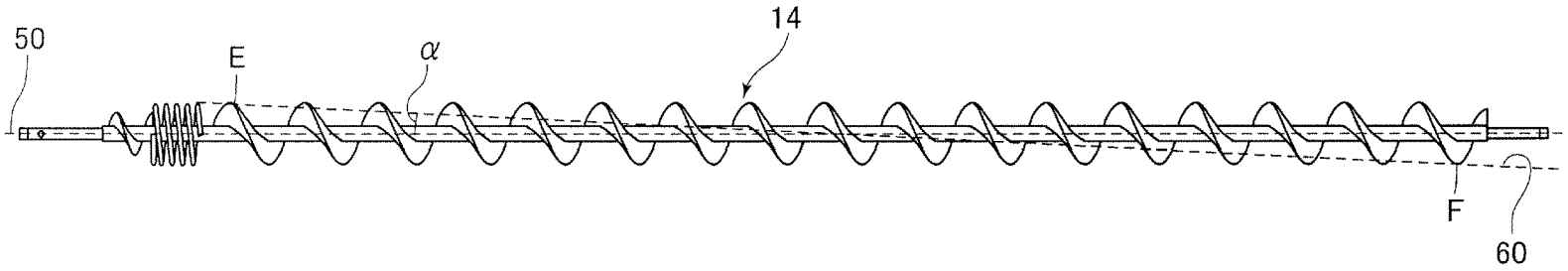
FIG. 7 is a diagram for description of a formation angle of an upper end of the third communication portion.

Therefore, the upper end 18*a* of the third communication port 18 is preferably formed such that a more downstream portion thereof, i.e., a first portion, is higher than a more upstream portion thereof, i.e., a second portion positioned upstream of the first portion, in the second direction D2 as illustrated in FIG. 6. Specifically, as illustrated in FIG. 7, the upper end 18*a* of the third communication port 18 is inclined by an angle $\alpha$ formed by a straight line 60 and the rotation axis 50 of the agitation screw 14. The straight line 60 is a line connecting a topmost portion E of the outer periphery of a downstream end portion of the agitation screw 14 and a bottommost portion F of the outer periphery of an upstream end portion of the agitation screw 14 in the second direction D2. In the case where the height of the third communication port 18 is not constant and the upper end 18*a* is inclined such that a more downstream portion thereof is higher than a more upstream portion thereof in the second direction D2 as described above, the developer peeled off the developing sleeve 3 and collected in the agitation chamber 12 is prevented from getting into an upper side portion of the third communication port 18 by the partition wall 15. As a result of this, the collected developer is not communicated to the development chamber 11 without being agitated.

In addition, in the exemplary embodiment described above, an example in which the first communication port 16 is defined such that the height of the first communication port 16 is constant as illustrated in FIG. 5 has been described. However, the configuration of the first communication port 16 is not limited to this exemplary embodiment. The height of the first communication port 16 may not be necessarily constant. For example, a modification embodiment in which the first communication port 16 is defined such that the height of the first communication port 16 increases gradually or stepwise from upstream to downstream in the second direction D2 may be employed. That is, the lowest portion of the upper end 16*a* of the first communication port 16 is disposed above the highest portion of the upper end 18*a* of the third communication port 18.

In addition, in the exemplary embodiment described above, an example in which the third communication port 18 and the first communication port 16 are defined such that the upper end 18*a* of the third communication port 18 and the upper end 16*a* of the first communication port 16 are discontinuous at a portion at which the downstream side of the third communication port 18 and the upstream side of the first communication port 16 in the second direction D2 are adjacent to each other has been described as illustrated in FIG. 5. The portion at which the downstream side of the third communication port 18 and the upstream side of the first communication port 16 in the second direction D2 are adjacent to each other will be referred to as an adjacency portion of the third communication port 18 and the first communication port 16. In this example, the height of the communication portion 34 increases stepwise, at the adjacency portion of the third communication port 18 and the first communication port 16, from the height of the upper end 18*a* of the third communication port 18 to the height of the upper end 16*a* of the first communication port 16. In other words, a configuration in which the minimum length from a bottom surface portion of a communication path to an upper portion of a second area of a first communication portion is longer than the maximum length from the bottom surface portion of the communication path to an upper portion of a first area of the first communication portion is employed. Here, the bottom surface portion corresponds to the bottom surface portion 2*c*, the upper portion of the second area corresponds to the upper end 16*a* of the first communication port 16, and the upper portion of the first area corresponds to the upper end 18*a* of the third communication port 18.

Alternatively, a modification embodiment in which the third communication port 18 and the first communication port 16 are defined such that the upper end 18*a* of the third communication port 18 and the upper end 16*a* of the first communication port 16 are continuous at the adjacency portion of the third communication port 18 and the first communication port 16 may be employed. In this modification embodiment, the height of the communication portion 34 gradually increases, at the adjacency portion of the third communication port 18 and the first communication port 16, from the height of the upper end 18*a* of the third communication port 18 to the height of the upper end 16*a* of the first communication port 16. Also in such a case, in the opening of the communication portion 34, a portion whose position in the second direction D2 is within the range corresponding to the coating area M corresponds to a first area, and a portion positioned downstream of the coating area M corresponds to a second area.

In the modification embodiments described above, any configuration may be employed as long as the maximum height L1 of the first area A1 whose position in the second direction D2 is within the range corresponding to the coating area M of the developing sleeve 3 is smaller than the maximum height L2 of the second area A2 downstream of the coating area M in the second direction D2 in a communication path of developer formed by the communication portion 34. However, the maximum height is not necessarily a length in the vertical direction. The maximum height indicates the maximum length from the bottom surface portion 2*c* to the upper ends 16*a* and 18*a* of the communication portion 34 in the respective areas of areas A1 and A2 when viewed in the plane perpendicular to the partition wall 15.

Although the image forming apparatus 100 of an intermediate transfer system that transfers toner images of respective colors from the photosensitive drums 10 of respective colors onto the intermediate transfer belt 25 through primary transfer and then collectively transfers a composite toner image of respective colors onto the recording material S through secondary transfer has been described in the exemplary embodiments described above, embodiments of the present invention is not limited to this example. For example, the present invention may be applied to an image forming apparatus of a direct transfer system that directly transfers toner images from photosensitive drums onto a recording material carried and conveyed by a transfer material conveyance belt.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2016-140688, filed on Jul. 15, 2016, and 2017-093144, filed on May 9, 2017, which are hereby incorporated by reference wherein in their entirety.

What is claimed is:

1. A developing device comprising:

a developer bearing member configured to be rotatable, bear developer containing toner and carrier, and convey the developer to a development area opposing an image bearing member;

a first chamber which is disposed below a rotation axis of the developer bearing member in a vertical direction and from which the developer is supplied to the developer bearing member;

a second chamber disposed so as to be exposed to the developer bearing member and configured to accommodate the developer having passed through the development area and collected from the developer bearing member;

a first conveyance screw portion disposed in the first chamber and configured to convey the developer in the first chamber in a first conveyance direction;

a second conveyance screw portion disposed in the second chamber, comprising a rotatable shaft portion, and configured to convey the developer in the second chamber in a second conveyance direction opposite to the first conveyance direction;

a partition wall configured to separate the first chamber from the second chamber;

a first communication portion configured to permit the developer in the second chamber to be communicated from the second chamber to the first chamber; and a second communication portion configured to permit the developer in the first chamber to be communicated from the first chamber to the second chamber, wherein the first communication portion defines a communication path through which the developer in the second chamber is communicated from the second chamber to the first chamber, the communication path having a first area and a second area, at least a part of the first area being positioned within a range corresponding to a developer coating area of the developer bearing member in the second conveyance direction, the second area being positioned downstream of the developer coating area of the developer bearing member in the second conveyance direction, and wherein a first length of the first area is shorter than a second length of the second area, the first length being a maximum length from a bottom surface portion of the communication path to an upper portion of the first area of the communication path, the second length being a maximum length from the bottom surface portion of the communication path to an upper portion of the second area of the communication path.

2. The developing device according to claim 1, wherein the upper portion of the first area of the first communication portion is disposed below a rotation axis of the second conveyance screw portion in the vertical direction, and wherein the upper portion of the second area of the first communication portion is disposed above the rotation axis of the second conveyance screw portion in the vertical direction.

3. The developing device according to claim 1, wherein, when viewed in a plane perpendicular to the partition wall, the upper portion of the second area of the first communication portion is provided on a component positioned above the bottom surface portion, and the component and an upper end of the second area of the first communication portion intersect at the upper portion of the second area.

4. The developing device according to claim 3, wherein the component positioned above the bottom surface portion is the partition wall.

5. The developing device according to claim 3, wherein the component positioned above the bottom surface portion is the developer bearing member.

6. The developing device according to claim 1, wherein, when viewed in a plane perpendicular to the partition wall, the upper portion of the first area of the first communication portion is between the upper portion of the second area of the first communication portion and the bottom surface portion of the communication path in a height direction of the partition wall.

7. The developing device according to claim 1, wherein, when viewed in a plane perpendicular to the partition wall, a size of the first area of the first communication portion is smaller than a size of the second area of the first communication portion.

8. The developing device according to claim 1, wherein a minimum length from the bottom surface portion of the communication path to the upper portion of the second area of the first communication portion is larger than a maximum length from the bottom surface portion of the communication path to the upper portion of the first area of the first communication portion.

9. The developing device according to claim 1, wherein a length from the bottom surface portion of the communication path to a first portion of the upper portion of the first area of the first communication portion is larger than a length from the bottom surface portion to a second portion positioned upstream of the first portion of the upper portion of the first area in the second conveyance direction.

10. The developing device according to claim 1, wherein a length from the bottom surface portion of the communication path to the upper portion of the first area of the first communication portion gradually increases from upstream to downstream in the second conveyance direction.

11. The developing device according to claim 1, wherein the second conveyance screw portion comprises a spiral ridge portion provided on an outer periphery of the shaft portion, and wherein a length of the first area of the first communication portion in the second conveyance direction is smaller than a pitch of the spiral ridge portion.

12. The developing device according to claim 1, wherein the first area of the first communication portion is disposed upstream of the second area of the first communication portion in the second conveyance direction.

13. The developing device according to claim 1, further comprising:

a developer replenishing portion configured to replenish the developer circulating between the first chamber and the second chamber; and a developer discharging portion disposed in the second chamber and configured to discharge a part of the developer circulating between the first chamber and the second chamber, wherein the second area of the first communication portion is disposed upstream of the developer discharging portion in the second conveyance direction.

14. The developing device according to claim 1, further comprising a returning screw portion disposed in the second chamber and configured to convey the developer in the second chamber in the first conveyance direction, wherein the second area of the first communication portion is disposed upstream of the returning screw portion in the second conveyance direction.

15. The developing device according to claim 1, wherein the first conveyance screw portion comprises a rotatable shaft portion, and wherein a rotation axis of the second conveyance screw portion is disposed above a rotation axis of the first conveyance screw portion in the vertical direction.

* * * * *